US009128449B2

(12) United States Patent
Akaishi et al.

(10) Patent No.: US 9,128,449 B2
(45) Date of Patent: Sep. 8, 2015

(54) FIXING DEVICE AND IMAGE FORMING APPARATUS

(71) Applicants: Masataka Akaishi, Kanagawa (JP); Tsuyoshi Ueno, Fukuoka (JP); Motokazu Hasegawa, Kanagawa (JP); Yuuki Oka, Kanagawa (JP)

(72) Inventors: Masataka Akaishi, Kanagawa (JP); Tsuyoshi Ueno, Fukuoka (JP); Motokazu Hasegawa, Kanagawa (JP); Yuuki Oka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/314,112

(22) Filed: Jun. 25, 2014

(65) Prior Publication Data

US 2015/0010319 A1 Jan. 8, 2015

(30) Foreign Application Priority Data

Jul. 4, 2013 (JP) ..... 2013-140726

(51) Int. Cl.
*G03G 15/00* (2006.01)
*G03G 15/20* (2006.01)

(52) U.S. Cl.
CPC ..... *G03G 15/80* (2013.01); *G03G 15/2014* (2013.01)

(58) Field of Classification Search
CPC ..... G03G 15/2014; G03G 15/80; G03G 15/2042; G03G 15/2053; G03G 2215/20
USPC ..... 399/67, 88, 328, 334
See application file for complete search history.

(56) References Cited

U.S. PATENT DOCUMENTS

| | | | | |
|---|---|---|---|---|
| 5,794,096 | A * | 8/1998 | Okabayashi | 399/33 |
| 6,630,651 | B2 | 10/2003 | Ohishi et al. | |
| 6,861,630 | B2 | 3/2005 | Kinouchi et al. | |
| 6,889,018 | B2 | 5/2005 | Kinouchi et al. | |
| 6,912,367 | B2 | 6/2005 | Miura | |
| 7,780,870 | B2 | 8/2010 | Kato et al. | |
| 8,461,497 | B2 | 6/2013 | Ishikawa | |
| 2003/0198481 | A1* | 10/2003 | Kikuchi et al. | 399/69 |
| 2004/0173603 | A1* | 9/2004 | Kinouchi et al. | 219/661 |
| 2014/0064764 | A1* | 3/2014 | Kim et al. | 399/67 |
| 2014/0072320 | A1 | 3/2014 | Ueno et al. | |

FOREIGN PATENT DOCUMENTS

| | | |
|---|---|---|
| JP | 2001-312178 | 11/2001 |
| JP | 2002-034241 | 1/2002 |
| JP | 2006-206813 | 8/2006 |
| JP | 2006-251526 | 9/2006 |
| JP | 4021707 | 12/2007 |
| JP | 4047644 | 2/2008 |
| JP | 4331633 | 9/2009 |
| JP | 2010-117431 | 5/2010 |
| JP | 2014-056114 | 3/2014 |

* cited by examiner

*Primary Examiner* — Francis Gray
(74) *Attorney, Agent, or Firm* — Harness, Dickey & Pierce, P.L.C.

(57) ABSTRACT

A fixing device includes a heating body; first and second coils for induction heating that heat the heating body by an induction heating method; a first switching element connected to the first coil for induction heating; a second switching element connected to the second coil for induction heating; a driving signal transmission unit that sends a first drive signal to the first switching element and a second drive signal to the second switching element so that the first switching element and the second switching element operate at the same timing to apply a first input voltage to the first coil for induction heating and a second input voltage to the second coil for induction heating; and a voltage drop unit that steps down the first input voltage applied to the first coil for induction heating so that the first input voltage is lower than the second input voltage.

5 Claims, 16 Drawing Sheets

FIXING DEVICE AND IMAGE FORMING APPARATUS

BACKGROUND OF THE INVENTION

1. Field of the Invention

The disclosures herein generally relate to a fixing device and an image forming apparatus, and in particular relate to a fixing device that heats a heating body by an induction heating method using plural coils for induction heating.

2. Description of the Related Art

An electrophotographic image forming apparatus in the related art has a fixing device for fixing a toner on a paper. The heating methods of the fixing device include an IH (Induction Heating) method. In a power unit for induction heating (inverter), an alternate current value applied to a coil for induction heating is controlled according to an operation frequency of a switching element mounted on the inverter (conduction time width in the switching element).

Moreover, in the image forming apparatus in the related art, papers having various sizes (widths) are used according to a specification. For example, Japanese Published Patent Applications No. 2006-206813 and 2001-312178 and Japanese Patent No. 4021707 describes an image forming apparatus in which plural coils for induction heating are arranged along an axis direction of a heating roller so as to fit a width of passing paper, and an electric power supplied to the coils for induction heating is controlled.

Moreover, in the image forming apparatus in the related art, when an electric power is supplied to each of the plural coils for induction heating arranged along a direction of a roller axis, an electric energy generated by each of the coils for induction heating is changed according to a temperature difference in a longitudinal direction of the roller. In the above operation, the plural coils for induction heating are driven in frequencies different from each other, and an interference sound may be generated.

In order to inhibit the interference sound as above, it is known to perform control by switching the timing of supplying the electric power to the plural coils for induction heating. However, when the timing of supplying the electric power is switched while the distribution ratio is maintained in order to inhibit the interference sound, the plural coils for induction heating heat with time division, and a time to reach the fixing temperature becomes long.

SUMMARY OF THE INVENTION

It is a general object of at least one embodiment of the present invention to provide a fixing device and an image forming apparatus that substantially obviate one or more problems caused by the limitations and disadvantages of the related art.

In one embodiment, a fixing device includes a heating body; a first coil for induction heating that heats the heating body by an induction heating method; a second coil for induction heating that heats the heating body by the induction heating method; a first switching element connected to the first coil for induction heating; a second switching element connected to the second coil for induction heating; a driving signal transmission unit that sends a first drive signal to the first switching element and a second drive signal to the second switching element so that the first switching element and the second switching element operate at the same timing to apply a first input voltage to the first coil for induction heating and a second input voltage to the second coil for induction heating; and a voltage drop unit that steps down the first input voltage applied to the first coil for induction heating so that the first input voltage is lower than the second input voltage.

In another embodiment, an image forming apparatus includes a fixing device which fixes a toner image generated based on image data on a recording medium. The fixing device includes a heating body; a first coil for induction heating that heats the heating body by an induction heating method; a second coil for induction heating that heats the heating body by the induction heating method; a first switching element connected to the first coil for induction heating; a second switching element connected to the second coil for induction heating; a driving signal transmission unit that sends a first drive signal to the first switching element and a second drive signal to the second switching element so that the first switching element and the second switching element operate at the same timing to apply a first input voltage to the first coil for induction heating and a second input voltage to the second coil for induction heating; and a voltage drop unit that steps down the first input voltage applied to the first coil for induction heating so that the first input voltage is lower than the second input voltage.

According to the present invention, a fixing device and an image forming apparatus that continuously supply an electric power to a heating coil without generating an interference sound are provided.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS (First Embodiment)

Figure 1:
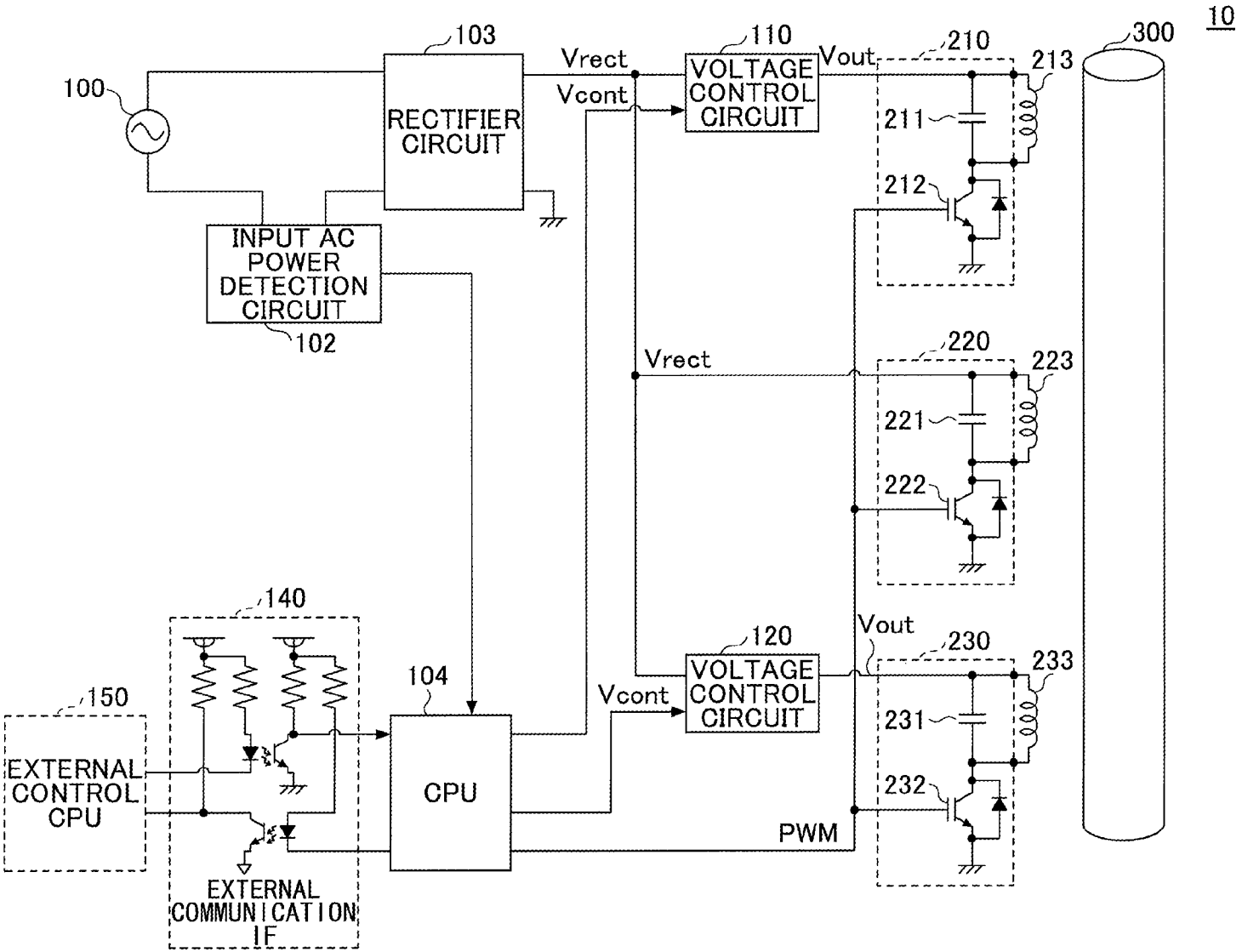
FIG. 1 is an explanatory diagram illustrating a fixing device according to a first embodiment.

In the following, a first embodiment of the present invention will be described with reference to the accompanying drawings. FIG. 1 is an explanatory diagram illustrating a fixing device according to the first embodiment.

The fixing device 10 according to the present embodiment includes a power source 100, an input AC (Alternating Current) power detection circuit 102, a rectifier circuit 103 and a CPU (Central Processing unit) 104. Moreover, the fixing device 10 according to the present embodiment further includes voltage control circuits 110, 120, coil drive units 210, 220 and 230 and heating coils 213, 223 and 233.

The CPU 104 of the fixing device 10 according to the present embodiment, upon receiving an instruction for fixing from an external control CPU 150 via an external communication IF (interface) 140, makes the coils for induction heating 213, 223 and 233 heat by the coil drive unit 210, 220 and 230, to heat the heating roller 300. In the present embodiment, the external communication IF (Interface) 140 may be provided in the fixing device 10 or may be provided outside the fixing device 10. Generally, the external communication IF is insulated by a photo coupler or the like in order to prevent a breakage to an internal electronic circuit. Moreover, the external control CPU 150 according to the present embodiment is a main control unit in the image forming apparatus which mounts the fixing device 10, for example. Moreover, the heating roller 300 according to the present embodiment may be included in the fixing device 10 or may be arranged outside the fixing device 10.

The voltage control circuits 110, 120 according to the present embodiment supplies voltage to the coil drive units 210, 230, to drive the heating coils 213, 233. Moreover, in the coil drive unit according to the present embodiment a drive signal to drive the heating coil 223 is supplied from the CPU 104.

The coil drive unit 210 according to the present embodiment is a resonance circuit including a resonance capacitor 211 and a switching element 212. The coil drive unit 220 according to the present embodiment is a resonance circuit including a resonance capacitor 221 and a switching element 222. The coil drive unit 230 according to the present embodiment is a resonance circuit including a resonance capacitor 231 and a switching element 232.

In the coil drive unit 210, 220 and 230 according to the present embodiment, the resonance capacitors are connected to the heating coils 213, 223 and 233 in parallel to form resonance circuits, respectively. Moreover, the switching elements 212, 222 and 232 are connected to the heating coils 213, 223 and 223 in series, to control the drive of the resonance circuits, respectively.

The switching elements 212, 222 and 232 according to the present embodiment are for example, power MOSFETs (Metal-Oxide-Semiconductor Field-Effect Transistors), IGBTs (Insulated Gate Bipolar Transistors), or the like. A signal from the CPU 104 is applied to a gate of each of the switching elements. The ON/OFF of each of the switching elements 212, 222 and 232 according to the present embodiment is controlled by an instruction from the CPU 104.

In the fixing device 10 according to the Present embodiment, a voltage $V_{rect}$ which is obtained by rectifying a voltage output from the power source voltage 100 at a rectifier circuit 103 is supplied to the voltage control circuits 110, 120 and the coil drive unit 220. Moreover, in the fixing device 10 according to the present embodiment, a control signal $V_{cont}$ output from the CPU 104 is supplied to the voltage control circuits 110 and 120.

Figure 2:
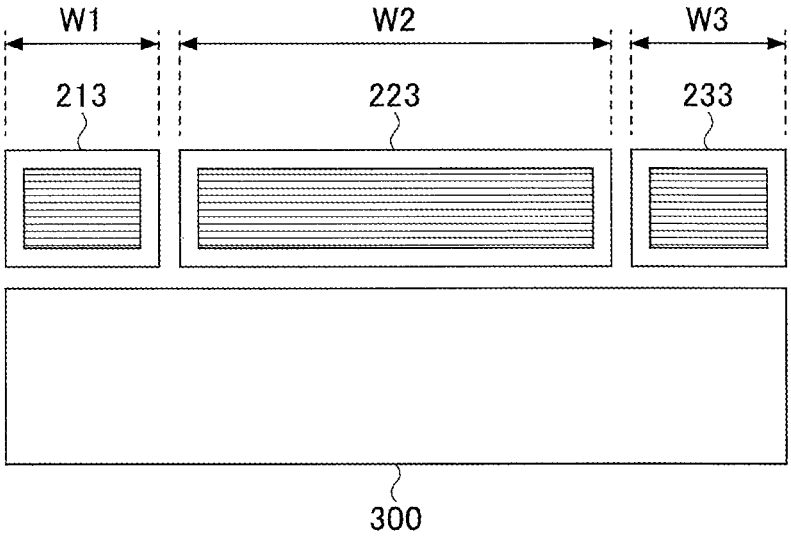
FIG. 2 is an explanatory diagram illustrating a heating roller according to the first embodiment.

Next, with reference to FIG. 2, the heating roller 300 according to the present invention will be described. FIG. 2 is an explanatory diagram illustrating the heating roller according to the first embodiment.

FIG. 2 schematically shows the heating coils 213, 223 and 233 in the longitudinal direction of the fixing device 10 and the heating roller 300.

In the present embodiment, the heating coils 213, 223 and 233 are divided in the longitudinal direction of the heating roller 300 according to the paper width are provided.

In the present embodiment, when the width of the heating coil 213 in the longitudinal direction is W1, the width of the heating coil 223 in the longitudinal direction is W2 and the width of the heating coil 233 in the longitudinal direction is W3, the respective heating coils are provided so that W1 is equal to W3 and less than W2.

That is, in the present invention, the heating coil 223 that heats a central part of the heating roller 300 is provided, and the heating coils 213 and 233 having smaller width than the heating coil 223 are provided on both ends of the heating coil 223.

In the fixing device 10 according to the present embodiment, by driving the coil drive units 210, 220 and 230 that drive these three heating coils 213, 223 and 233 with the same frequency, an electric power is supplied continuously to the heating coils 213, 223 and 233 without generating interference sound.

Moreover, in the fixing device 10 according to the present embodiment, the voltage supplied to the heating coils 213 and 233 and the voltage supplied to the heating coil 223 are adjusted. Specifically, the region where the heating coil 223 heats on the heating roller 300 is larger than the regions where the heating coils 213 and 233 heat. Accordingly, the electric power supplied to the heating coil 223 is required to be greater than the electric powers supplied to the heating rollers 213, 233.

The coil drive units 210, 220 and 230 according to the present embodiment operate by the drive signals with the same frequency. That is, this shows that time when the voltages are supplied to the respective coil drive units 210, 220 and 230 are the same. Accordingly, in the present embodiment, the voltage control circuits 110, 120 control so that the voltage $V_{out}$ applied to the heating coils 213, 233 is less than the voltage $V_{rect}$ applied to the heating coil 223.

That is, in the present embodiment, the plural heating coils 213, 223 and 233 with the same frequency and voltages applied to the plural heating coils 213, 223 and 233 are controlled so that the electric powers provided to each of the plural heating coils are the target values set in advance.

Specifically, the coil drive unit 220 according to the present embodiment is driven by a PWM (pulse-width modulation) signal corresponding to the electric power (target value) set in the CPU 104. Moreover, in the present embodiment, when the control signal $V_{cont}$ output from the CPU 104 is provided to the voltage control circuits 110, 120, the voltage control circuits 110, 120 output a voltage corresponding to the electric power which is set according to the control signal $V_{cont}$. The voltage output from the voltage control circuits 110, 120 is supplied to the coil drive units 210, 230 and applied to the heating coils 213, 233.

The operation of the CPU 104 included in the fixing device 10 according to the present embodiment will be explained in the following.

The CPU 104 according to the present embodiment detects the electric power supplied from the power source voltage 100 by the AC input power detection circuit 102. Next, the CPU 104 refers to a target value of the electric power, which is set from a CPU 150 outside the fixing device 10, and outputs a PWM signal that makes the switching elements 212, 222 and 232 of the respective coil drive units turn on/off at the same timing.

In the present embodiment, according to the control as described above, the drive frequencies of the switching elements 212, 222 and 232 are matched, and the interference sound between the heating coils 213, 223 and 233 can be suppressed.

Figure 3A:
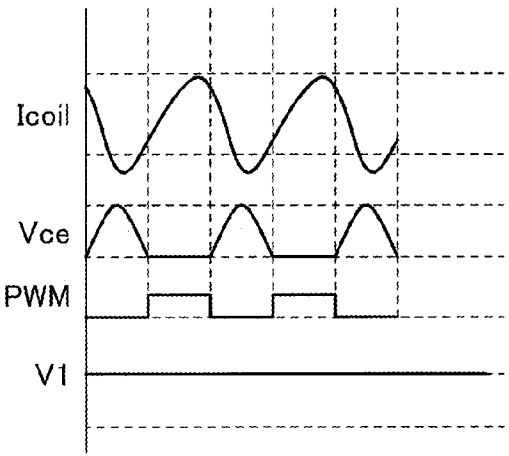
FIGS. 3A to 3C are explanatory diagrams illustrating a control of a voltage by a voltage control circuit according to the first embodiment.
Figure 3B:
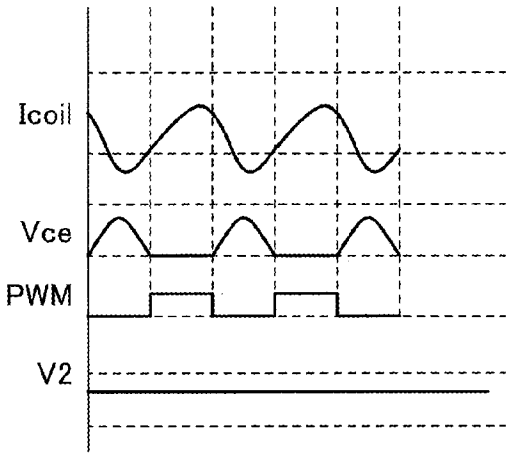
Figure 3C:
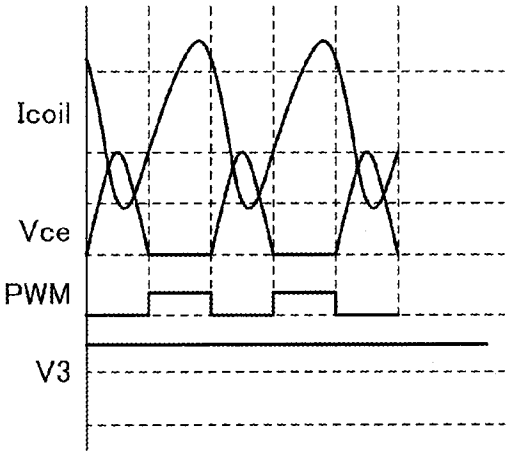

In the following, with reference to FIGS. 3A to 3C, a control of a voltage of the voltage control circuit 110 according to the present embodiment will be explained. FIGS. 3A to 3C are explanatory diagrams illustrating the control of the voltage by the voltage control circuit according to the first embodiment. FIGS. 3A to 3C show, for example, the case where the voltage control circuit 110 controls a voltage applied to the heating coil 213.

In the coil drive unit 210, when the PWM signal supplied to the switching element 212 is in an ON state (H level), a coil current $I_{coil}$ flows in the heating coil 213. In this stage, a path between the collector and the emitter of the switching element 212 is in a conducting state, and a voltage between the collector and the emitter $V_{ce}$ is 0 V as shown in FIG. 3A. Next, when the PWN signal becomes OFF state (L level), the coil current $I_{coil}$ does not flow into GND, the resonance capacitor 211 is charged and the voltage between the collector and the emitter $V_{ce}$ of the switching element 212 increases.

Moreover, since the electric charges charged in the resonance capacitor 211 are discharged, the coil current $I_{coil}$ which is an opposite direction to the heating coil 213 flows, and the coil current $I_{coil}$ goes from zero to negative. Then, a diode embedded in the switching element 212 conducts and the voltage between the collector and the emitter becomes nearly 0 V. In the coil drive unit 210, during the period when the embedded diode conducts, by changing the PWM signal to the ON state again, it becomes possible to make the switching element 212 work with low loss. By repeating the switching operation using the resonance operation, it becomes possible to make a current with high frequency flow in the heating coil 213.

FIG. 3B is a diagram showing that by making the voltage V2 applied to the heating coil 213 less than the voltage V1 in FIG. 3A, the coil current in the heating coil 213 $I_{coil}$ decreases while the switching operation is repeated in a state where the ON width of the PWM signal is the same. In the present embodiment, by lowering the voltage V1, the coil current becomes smaller.

FIG. 3C is a diagram showing that by making the voltage V3 applied to the heating coil 213 greater than the voltage V1 in FIG. 3A, the coil current in the heating coil 213 $I_{coil}$ increases while the switching operation is repeated in a state where the ON width of the PWM signal is the same.

In this way, in the present embodiment, by controlling the voltage applied to the heating coil 213, the set electric power can be supplied without changing the ON width of the PWM signal supplied to the switching element 212 of the coil drive unit 210.

That is, in the present embodiment, while controlling the respective coil drive units with the PWM signal having the same frequency, the voltage applied to the heating coils 213, 233 can be controlled. Accordingly, in the present embodiment in the case of inputting a large electric power, for example, while making the ON width of the PWM signal the same, the voltage applied to the heating coils 213, 233 can be made lower than the voltage applied to the heating coil 222.

Figure 4:
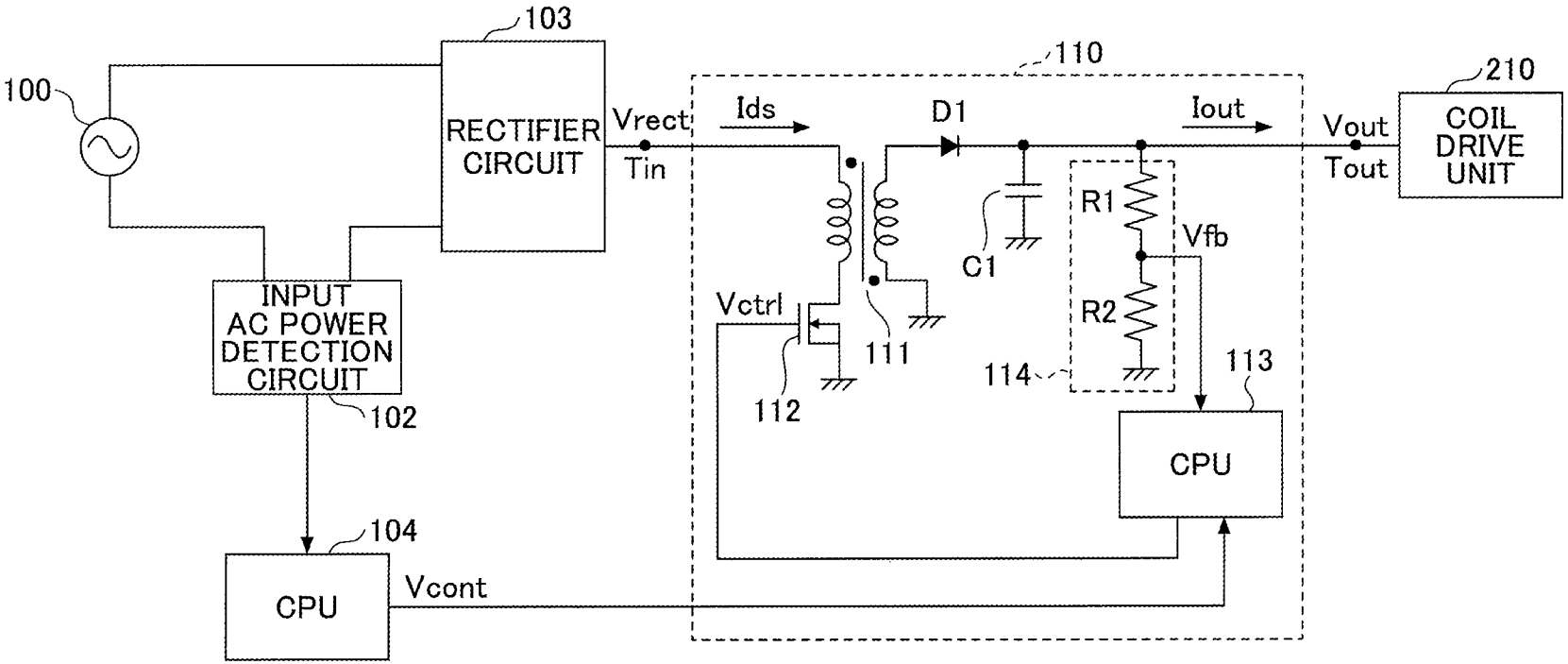
FIG. 4 is a diagram illustrating an example of the voltage control circuit according to the first embodiment.

Next, with reference to FIGS. 4 and 5, the voltage control circuits 110, 120 will be explained. Meanwhile, in the present embodiment, since the configurations of the voltage control circuits 110, 120 are almost the same, in the following explanation, the configuration of the voltage control circuit 110 will be explained as an example. FIG. 4 is a diagram illustrating an example of the voltage control circuit according to the first embodiment.

In the voltage control circuit 110 as shown in FIG. 4, a flyback type AC (alternate current)/DC (Direct Current) conversion circuit is used.

The voltage control circuit 110 according to the present embodiment includes a power transformer 111, the switching element 112, the CPU 113, the diode D1, the capacitor C1, and resistors R1 and R2.

To the voltage control circuit 110, the voltage $V_{rect}$ obtained by rectifying an AC voltage at the rectifier circuit 103 is supplied.

An input terminal Tin of the voltage control circuit 110 is connected with the switching element 112 via a primary winding of the power transformer 111. The ON/OFF of the switching element 112 is controlled by the drive signal, which will be denoted $V_{ctrl}$ signal in the following, from the CPU 113.

A secondary winding of the power transformer 111 is connected with an output terminal Tout of the voltage control unit 110 via the diode D1. An output voltage $V_{out}$ output from the output terminal Tout is supplied to the coil drive unit 210. One end of the capacitor C1 is connected between the diode D1 and the output terminal Tout. The other end of the capacitor C1 is connected to ground. Moreover, to the output terminal Tout, a voltage-dividing circuit 114 is connected which divides the output voltage $V_{out}$. The voltage-dividing circuit 114 is a circuit in which the resister R1 and the resister R2 are connected in series. The CPU 113 is connected to the connection point at which the resister R1 and the resister R2 are connected.

To the CPU 113 according to the present embodiment, the control signal $V_{cont}$ is supplied from the CPU 104. In the CPU 113, a target value of electric power supplied to the coil drive unit 210 is set by the control signal $V_{cont}$. The CPU outputs the $V_{ctrl}$ signal that controls the ON/OFF of the switching element 112, so that the output voltage $V_{out}$ from the voltage control circuit 110 is a voltage corresponding to the target value, based on the target value of the electric power and a voltage $V_{fb}$ at the connection point of the resister R1 and the resister R2.

Figure 5:
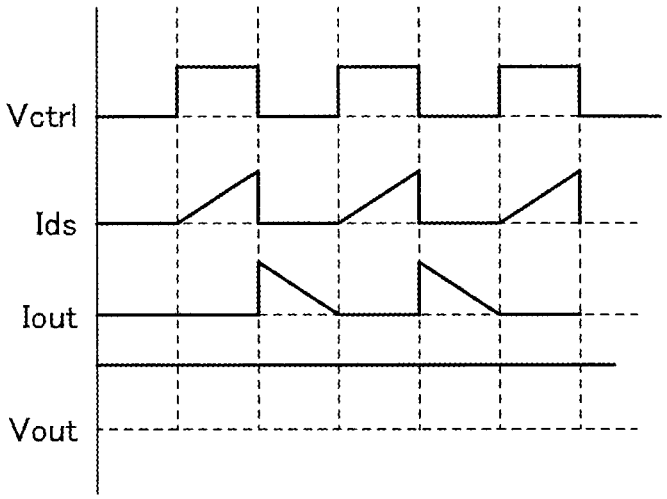
FIG. 5 is a diagram illustrating an example of an operational waveform in the voltage control circuit according to the first embodiment.

FIG. 5 is a diagram illustrating an example of an operational waveform in the voltage control circuit according to the first embodiment.

In the voltage control circuit 110 according to the present embodiment, when the $V_{ctrl}$ signal is changed to the ON state (high level), an electric current $I_{ds}$ having a triangular waveform flows in the primary winding. When the $V_{ctrl}$ signal is changed to the OFF state (low level) from the ON state, the current Ids in the primary winding becomes zero, a current $I_{out}$ flows in the diode D1 on a secondary side of the power transformer 111. A step-up/step-down of the output voltage $V_{out}$ becomes possible according the ON width of the $V_{ctrl}$ signal to the switching element 112.

That is, the CPU 113 according to the present embodiment steps up the output voltage $V_{out}$ by broadening the ON width of the $V_{ctrl}$ signal, and steps down the output voltage $V_{out}$ by narrowing the ON width.

As described above, in the voltage control circuit 110 according to the present embodiment, based on the divided voltage $V_{fb}$ of the output voltage $V_{out}$ and the target value for the electric power supplied to the heating coil 213, the output value $V_{out}$ is assumed to be a voltage corresponding to the target value. Accordingly, the coil drive unit 210 according to the present embodiment, based on the output voltage $V_{out}$, can make the electric power supplied to the heating coil 213 as the target value. That is, in the present embodiment, the electric power supplied to the heating coil can be controlled in accordance with the size of the heating coil.

Moreover, in the present embodiment, the controls of the ON/OFF for the switching elements 212, 222 and 232 of the coil drive units 210, 220 and 230 are performed at the same timing.

Accordingly, in the present embodiment, the electric power can be continuously supplied to heating coils without generating an interference sound.

Meanwhile, in the present embodiment, the explanation is provided for the case where all the heating coils 213, 223 and 233 are driven, but the present invention is not limited to this. In the present embodiment, for example, according to the width of the recording medium which is a fixing object, the drive of the heating coils 213 and 233 may be halted. The CPU 104 according to the present embodiment may drive only the heating coil 223, for example, in case where the width of the recording medium is less than a coil width of the heating coil 223 or the like. In the present embodiment, for example, the external control CPU 150 may detect the width of the recording medium based on image data and send the width to the CPU 104.

In the following, with reference to FIGS. 6 and 7, effects in the present embodiment will be explained.

Figure 6:
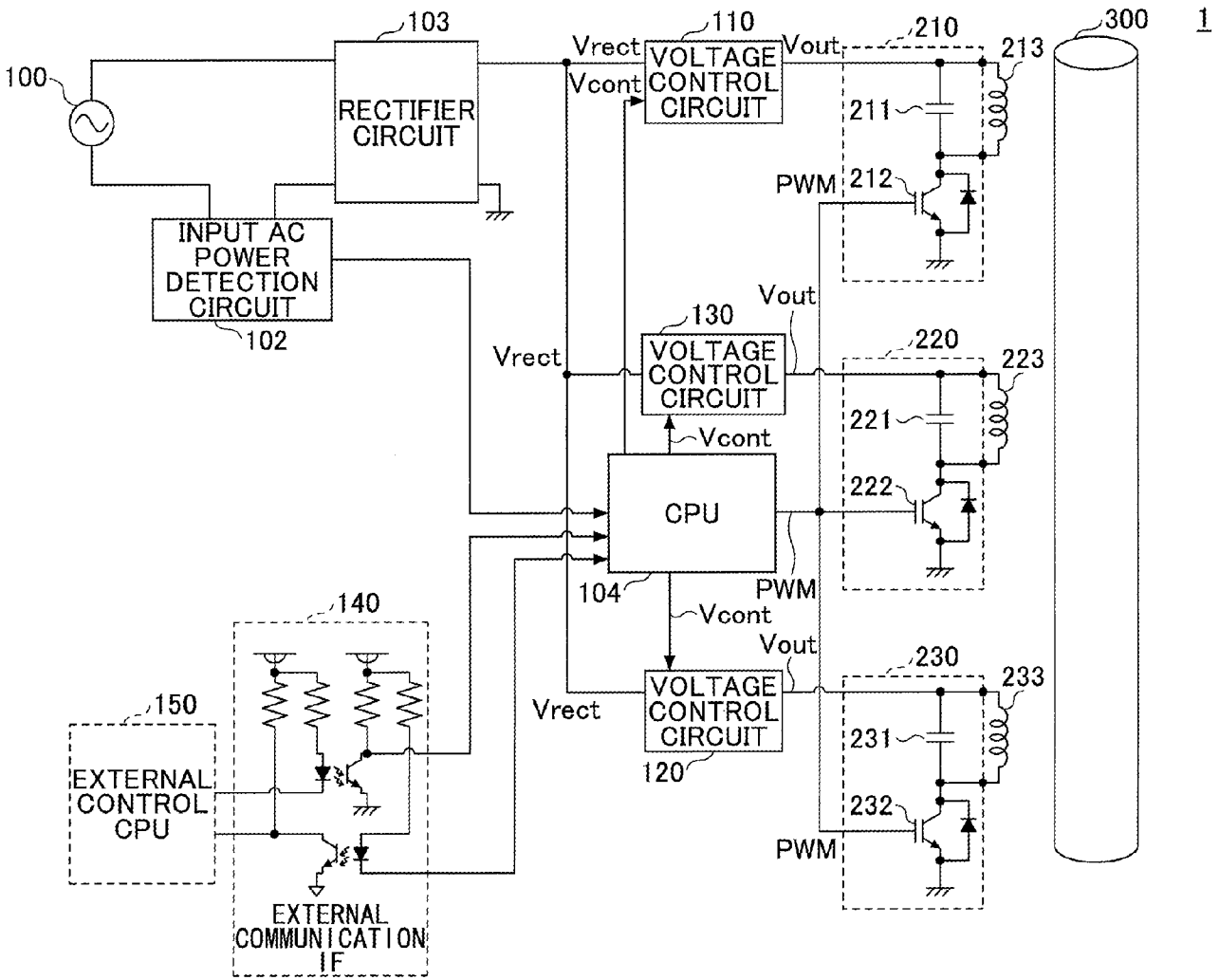
FIG. 6 is an explanatory diagram illustrating a comparative example for comparison with the fixing device according to the first embodiment.

FIG. 6 is an explanatory diagram illustrating a comparative example for comparison with the fixing device according to the first embodiment. In a fixing device 1 shown in FIG. 6, in the preceding stages of all the coil drive unit 210, 220 and 230, the voltage control circuits 110, 130 and 120 are inserted.

Figure 7:
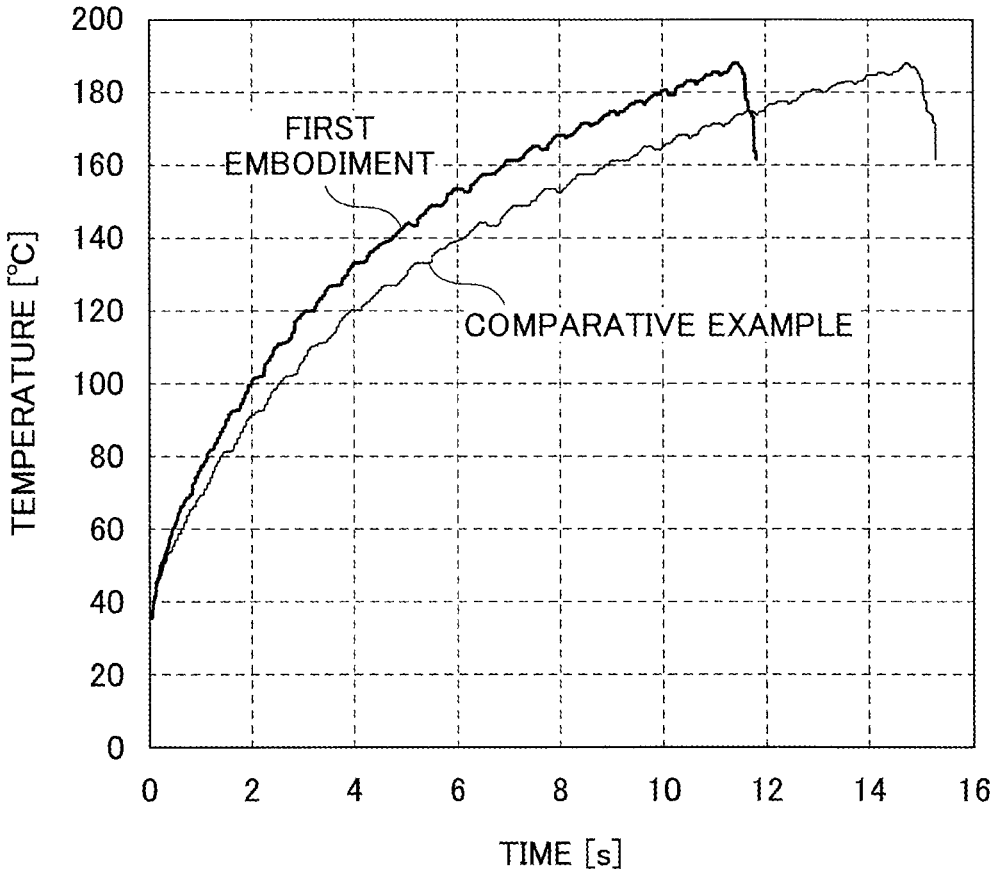
FIG. 7 is a diagram illustrating a result of implementation of heating experiments in the first embodiment and in the comparative example.

FIG. 7 is a diagram illustrating a result of implementation of heating experiments in the first embodiment and in the comparative example. FIG. 7 shows a result of comparison of a temperature rise performance of the heating coil 223 in the fixing device 10 according to the first embodiment and a temperature rise performance of a heating coil 223 in the fixing device of the comparative example.

In the fixing device 10 according to the first embodiment, it is found that the heating coil 223 can be heated earlier.

Meanwhile, in the heating experiments, the model of the image forming apparatus is "Imagio MP C5000". The incident power is 1000 W. The size of the heating coil 223 corresponds to the length of an A4-size paper in the longitudinal direction. The position of measurement is in a central portion of the coil in front of a nip.

Usually, in the case of using a voltage control circuit in a fixing device, since a loss of electric power occurs in the AC/DC voltage conversion, the heating roller 300 is heated with an electric power less than the target value of the set electric Power, and the fixing performance degrades.

Moreover, the larger the size of the heating coil, the more prominently the loss of electric power appears. For this reason, the voltage control circuit is not adequate to a case of, for example, providing a large amount of power to the coil drive unit. In the present embodiment, a voltage control circuit is not included in the preceding stage of the coil drive unit 220 that drives the heating coil 223 requiring a large amount of power.

Accordingly, in the present embodiment, the loss of electric power generated by the voltage control circuit 130 provided in the preceding stage of the heating coil 223 is removed, and the electric power supplied to the coil drive unit 220 can be brought closer to the target value. Consequently, as shown in FIG. 7, it can be heated in a shorter time than in the fixing device 1 having the voltage control circuit 130.

(Second Embodiment)

A second embodiment of the present invention will be explained with reference to the drawings in the following. In the second embodiment of the present invention, a forward type voltage control circuit is used, which is different from the first embodiment. Accordingly, in the following explanation in the second embodiment, only a difference from the first embodiment will be explained. To the member having the same functional configuration as in the first embodiment, the same reference numeral is assigned as the reference numeral used in the explanation in the first embodiment, and the explanation thereof will be omitted.

Figure 8:
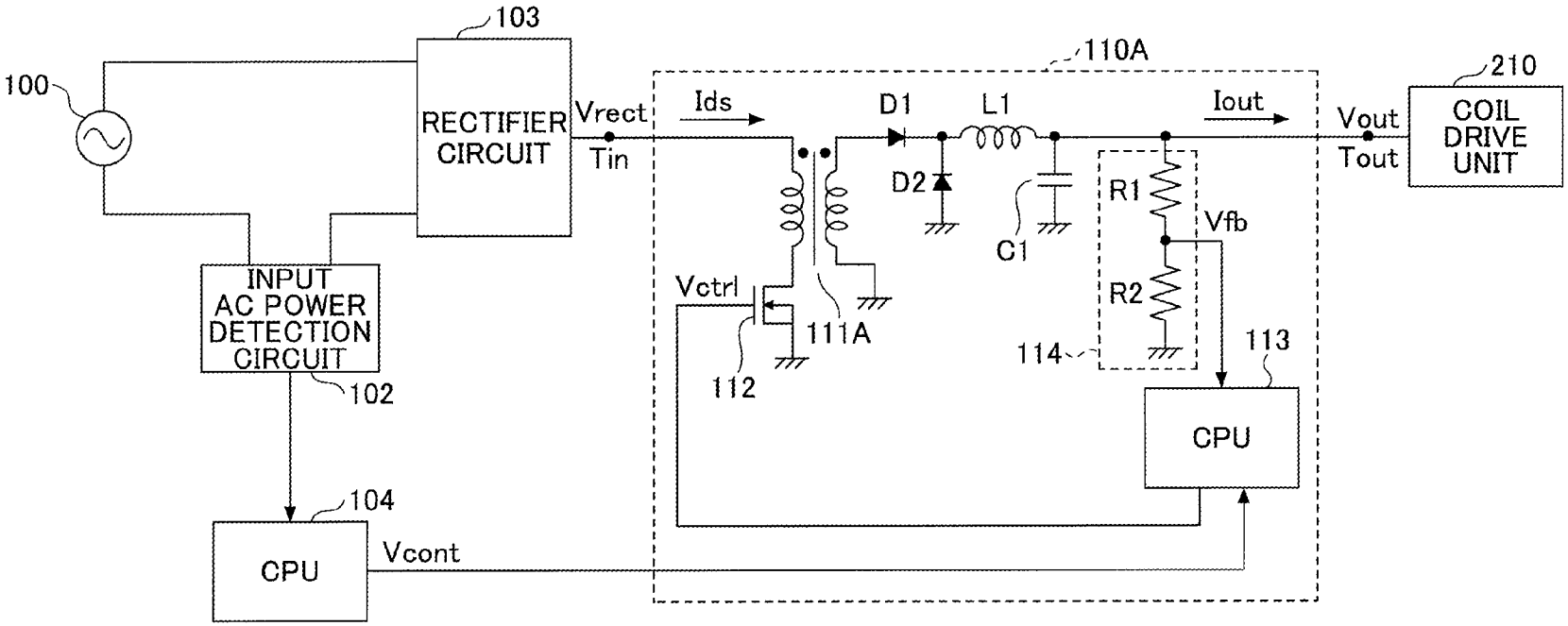
FIG. 8 is a diagram illustrating an example of a voltage control circuit according to a second embodiment.

FIG. 8 is a diagram illustrating an example of a voltage control circuit according to the second embodiment. The voltage control circuit 110A according to the present embodiment includes a power transformer 111A, a switching element 112, a CPU 113, diodes D1 and D2, a capacitor C1, a coil L1, and resistors R1 and R2.

A secondary winding of the power transformer 111A is connected with an output terminal Tout via the diode D1 and the coil L1. The diode D2 is connected between a connection point of the diode D1 and the coil L1 and the ground.

Figure 9:
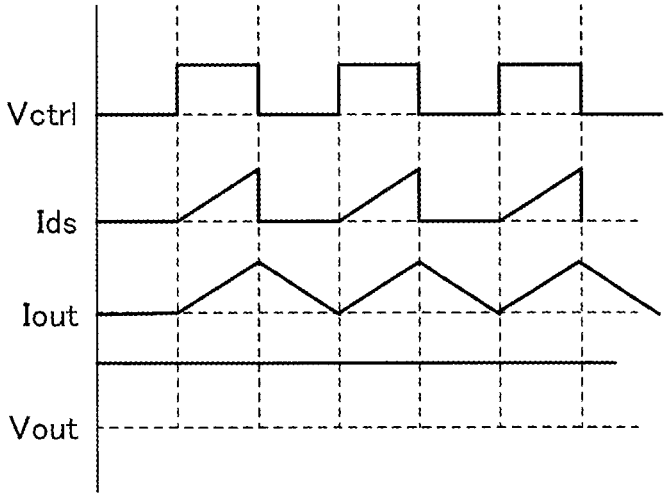
FIG. 9 is a diagram illustrating an example of an operational waveform in the voltage control circuit according to the second embodiment.

FIG. 9 is a diagram illustrating an example of an operational waveform in the voltage control circuit according to the second embodiment.

In the voltage control circuit 110A according to the present embodiment, when the Vctrl signal is changed to the ON state (high level), an electric current ids having a triangular waveform flows in the primary winding. Moreover, an electric current $I_{out}$ flows in the diodes D1 and D2 on a secondary side of the power transformer 111, and charged in the coil L1. When the $V_{ctrl}$ signal is changed to the OFF state (low level) from the ON state in the voltage control circuit 110A, the current Ids in the primary winding becomes zero, the electric current $I_{out}$ charged in the coil L1 flows. A step-up/step-down of the output voltage $V_{out}$ becomes possible according to the ON width of the $V_{ctrl}$ signal to the switching element 112.

(Third Embodiment)

A third embodiment of the present invention will be explained with reference to the drawings in the following. In the third embodiment of the present invention, plural heating coils arranged at both ends of the heating roller 300 are connected to the same voltage control circuit, which is different from the first embodiment. Accordingly, in the following explanation in the third embodiment, only a difference from the first embodiment will be explained. To the member having the same functional configuration as in the first embodiment, the same reference numeral is assigned as the reference numeral used in the explanation in the first embodiment, and the explanation thereof will be omitted.

Figure 10:
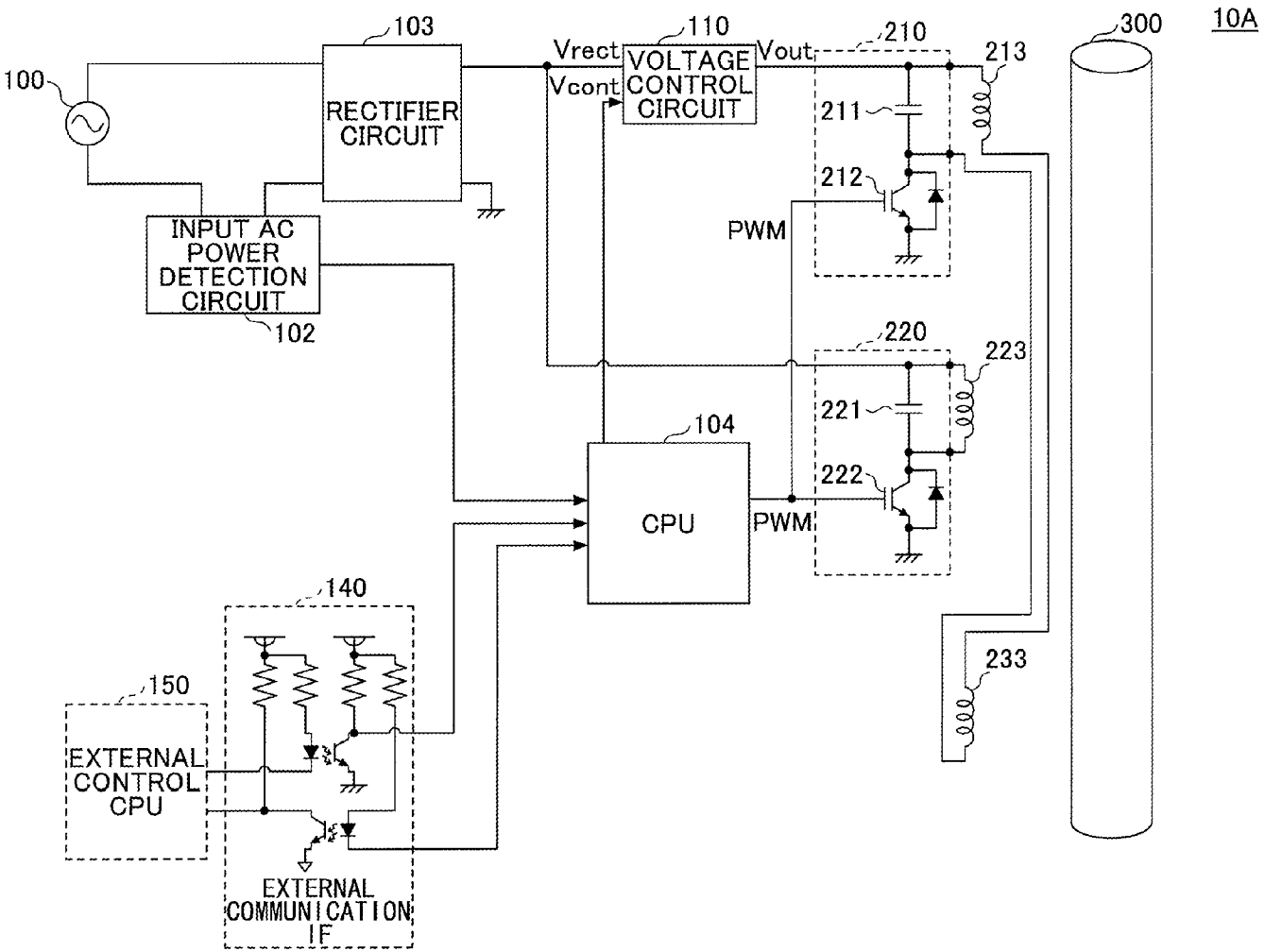
FIG. 10 is a first explanatory diagram illustrating a fixing device according to a third embodiment.

FIG. 10 is a first explanatory diagram illustrating a fixing device according to the third embodiment.

In the fixing device 10A according to the present embodiment, the heating coils 213 and 233, which are connected in series, are connected to the coil drive unit 210.

Figure 11:
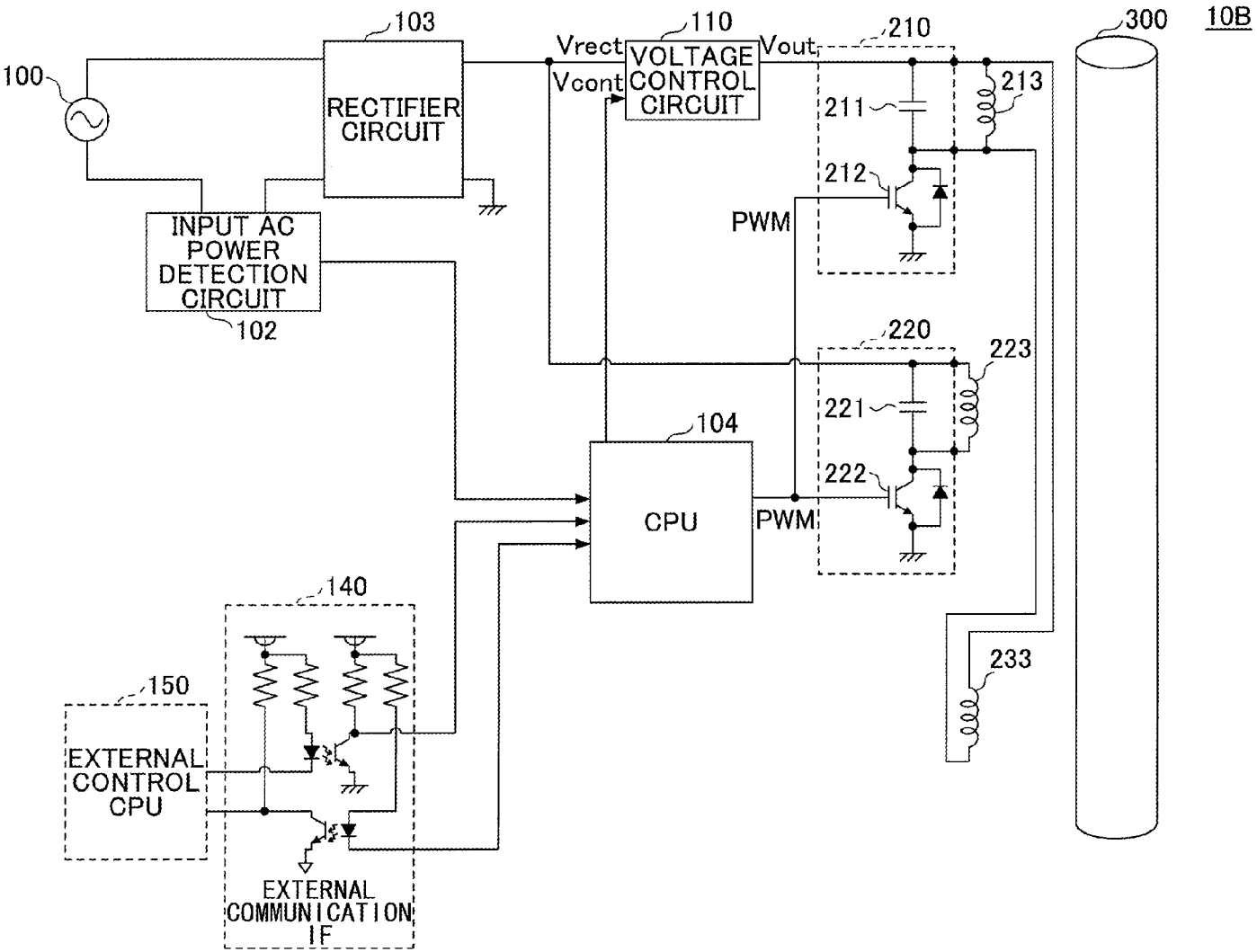
FIG. 11 is a second explanatory diagram illustrating the fixing device according to the third embodiment.

FIG. 11 is a second explanatory diagram illustrating the fixing device according to the third embodiment.

In the fixing device 10B according to the present embodiment, the heating coils 213 and 233, which are connected in parallel, are connected to the coil drive unit 210.

The coil drive unit 210 shown in FIG. 10 and FIG. 11, to which the output voltage $V_{out}$ is supplied from the voltage control circuit 110, drives the heating coils 213 and 233.

As described above, by using the same voltage control circuit 110 and the coil drive unit 210 for driving the two heating coils 213 and 233, the electric power supplied to the heating coil 213 can be the same as the electric power supplied to the heating coil 233. That is, in the present embodiment, positions on the heating roller 300 which correspond to the heating coils 213 and 233 can be heated to the same temperature.

Moreover, in the present embodiment, the voltage control circuit 120 and the coil drive unit 230 corresponding to the heating coil 233 are not necessary. Accordingly, in the fixing device 10A according to the present embodiment, the circuit size can be reduced.

(Fourth Embodiment)

A fourth embodiment of the present invention will be explained with reference to the drawings in the following. In the fourth embodiment of the present invention, plural heating coils are connected to the same voltage control circuit, which is different from the first embodiment. Accordingly, in the following explanation in the fourth embodiment, only a difference from the first embodiment will be explained. To the member having the same functional configuration as in the first embodiment, the same reference numeral is assigned as the reference numeral used in the explanation in the first embodiment, and the explanation thereof will be omitted.

Figure 12:
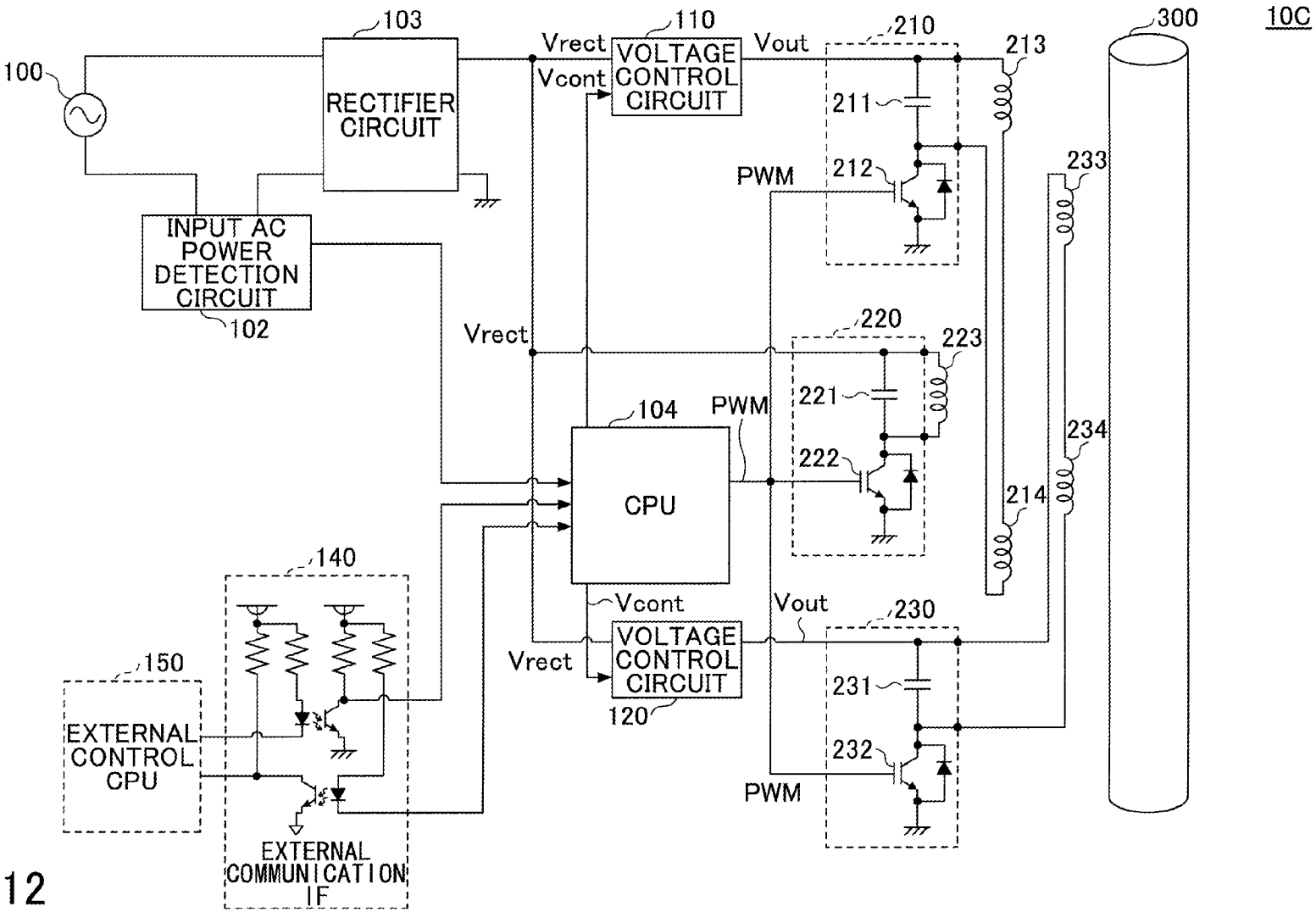
FIG. 12 is an explanatory diagram illustrating a fixing device according to a fourth embodiment.

FIG. 12 is an explanatory diagram illustrating a fixing device according to the fourth embodiment.

In the fixing device 10C according to the present embodiment, the heating coil 213 and the heating coil 214 are connected in series to the coil drive unit 210. Moreover, in the fixing device 100, the heating coil 233 and the heating coil 234 are connected in series to the coil drive unit 230.

In the fixing device 10C according to the present embodiment, in the case where, for example, the paper width is comparable with the width of the heating roller 300 in the longitudinal direction, all the heating coils are driven. Moreover, when the paper width is shorter than the width of the heating roller 300 in the longitudinal direction, for example, the fixing device 100 according to the present embodiment may drive only the heating coils 223, 233 and 234.

Moreover, regarding the heating coil according to the present embodiment, for example, a heating coil may be provided corresponding to the heating region of the heating roller 300.

(Fifth Embodiment)

A fifth embodiment of the present invention will be explained with reference to the drawings in the following. In the fifth embodiment of the present invention, the coil drive unit is an electric current resonance circuit, which is different from the first embodiment. Accordingly, in the following explanation in the fifth embodiment, only a difference from the first embodiment will be explained. To the member having the same functional configuration as in the first embodiment, the same reference numeral is assigned as the reference numeral used in the explanation in the first embodiment, and the explanation thereof will be omitted.

Figure 13:
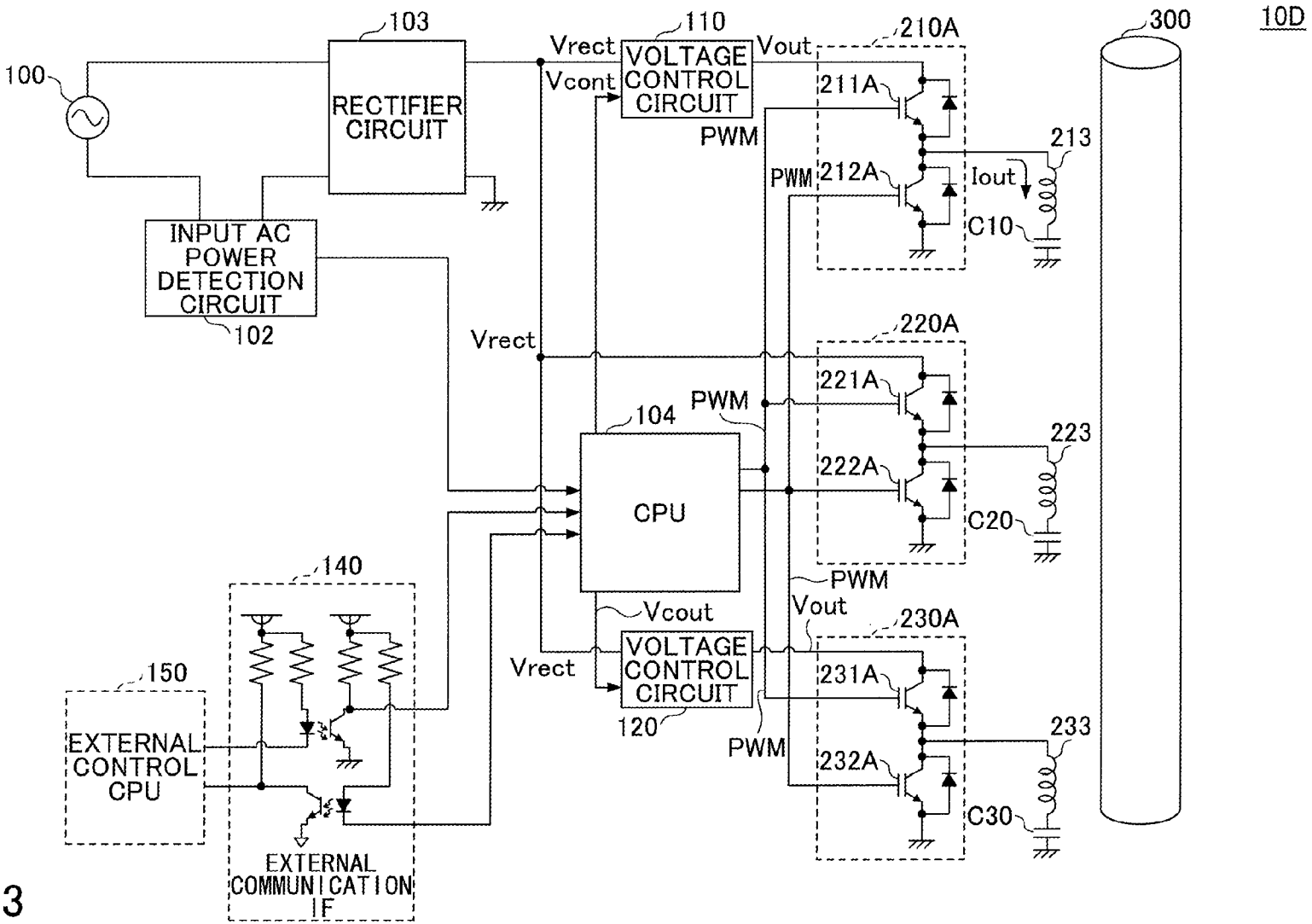
FIG. 13 is an explanatory diagram illustrating a fixing device according to a fifth embodiment.

FIG. 13 is an explanatory diagram illustrating a fixing device according to the fifth embodiment. The fixing device 10D according to the Present embodiment includes coil drive units 210A, 220A and 230A.

Since configurations of the coil drive units 210A, 220A and 230A are the same, in the following explanation, the coil drive unit 210A will be explained as an example.

The coil drive unit 210A according to the present embodiment includes switching elements 211A and 212A. To gates of the switching elements 211A and 212A, a PWM signal is supplied from the CPU 104.

In the coil drive unit 210A, when the PWM signal supplied to the switching element 211A is changed to the ON state (H level), an electric current Icoil flows in the heating coil 213, and electric charges are charged in the resonance capacitor C10. Next, when the PWM signal supplied to the gate of the switching element 211A changes to the OFF state (L level) and a PWM signal supplied to the gate of the switching element 212A changes to the ON state (H level), an electric current of an opposite direction $I_{coil}$ flows in the heating coil 213.

In the present embodiment, by switching the PWM signals supplied to the switching element 211A and to the gate of the switching element 212A between ON and OFF alternately, an electric current with high frequency flows in the heating coil 213. The switching elements 221A and 222A included in the coil drive unit 220A and the switching elements 231A included in the coil drive unit 230A are also driven by the same operation as the coil drive unit 210A. In the present embodiment, the same effect as in the first embodiment can be obtained.

(Sixth Embodiment)

A sixth embodiment of the present invention will be explained with reference to the drawings in the following. In the sixth embodiment of the present invention, the coil drive unit in the third embodiment is an electric current resonance circuit. Accordingly, in the following explanation in the sixth embodiment, only a difference from the third embodiment will be explained. To the member having the same functional configuration as in the third embodiment, the same reference numeral is assigned as the reference numeral used in the explanation in the third embodiment, and the explanation thereof will be omitted.

Figure 14:
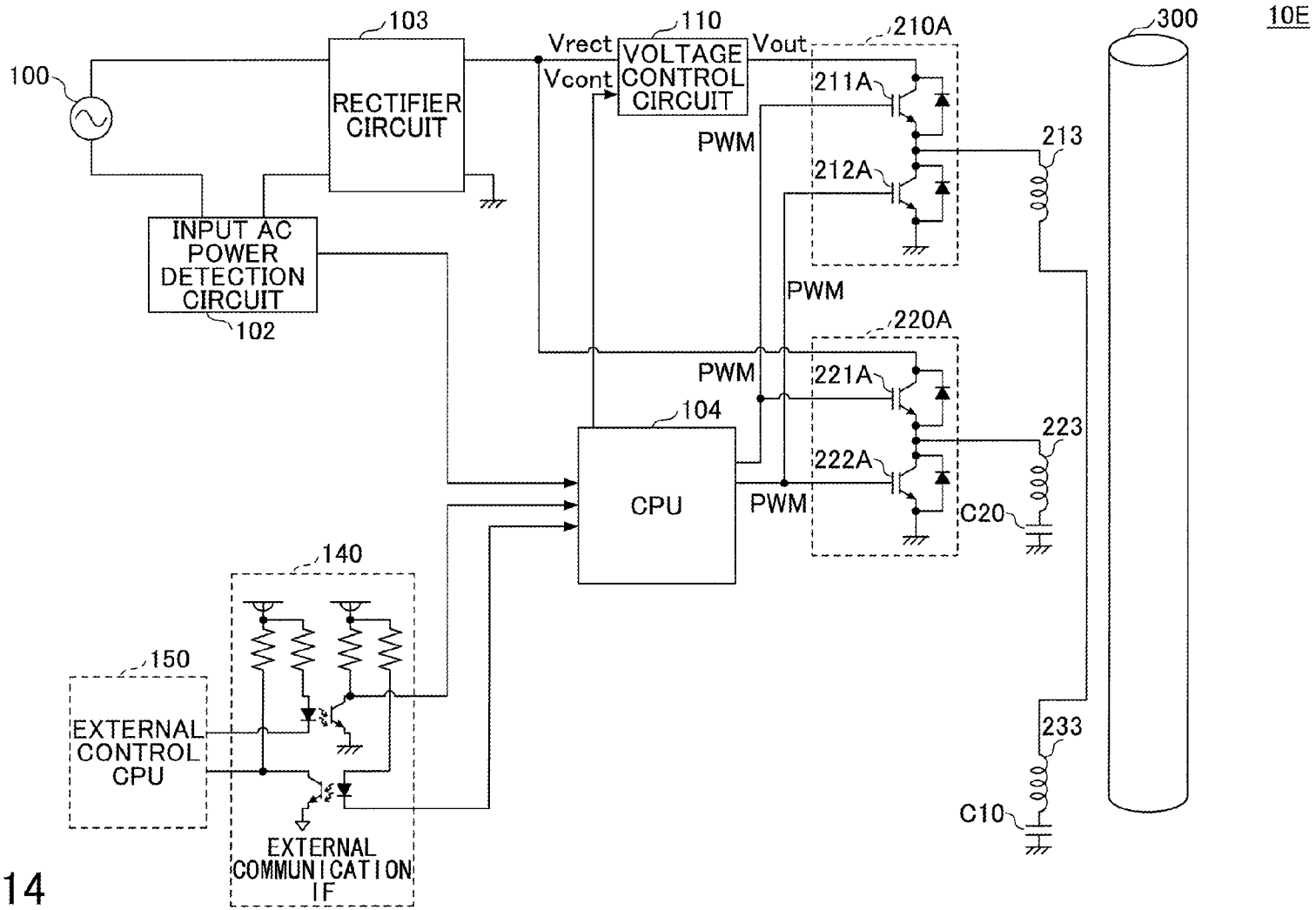
FIG. 14 is a first explanatory diagram illustrating a fixing device according to a sixth embodiment.

FIG. 14 is a first explanatory diagram illustrating a fixing device according to the sixth embodiment.

In the fixing device 10E according to the present embodiment, the heating coil 213 and the heating coil 233 which are connected in series are connected to the coil drive unit 210A, and a resonance capacitor C10 is connected between the heating coil 233 and the ground. Moreover, the heating coil 223 is connected to the coil drive unit 220A according to the present embodiment, and a resonance capacitor C20 is connected between the heating coil 223 and the ground.

Figure 15:
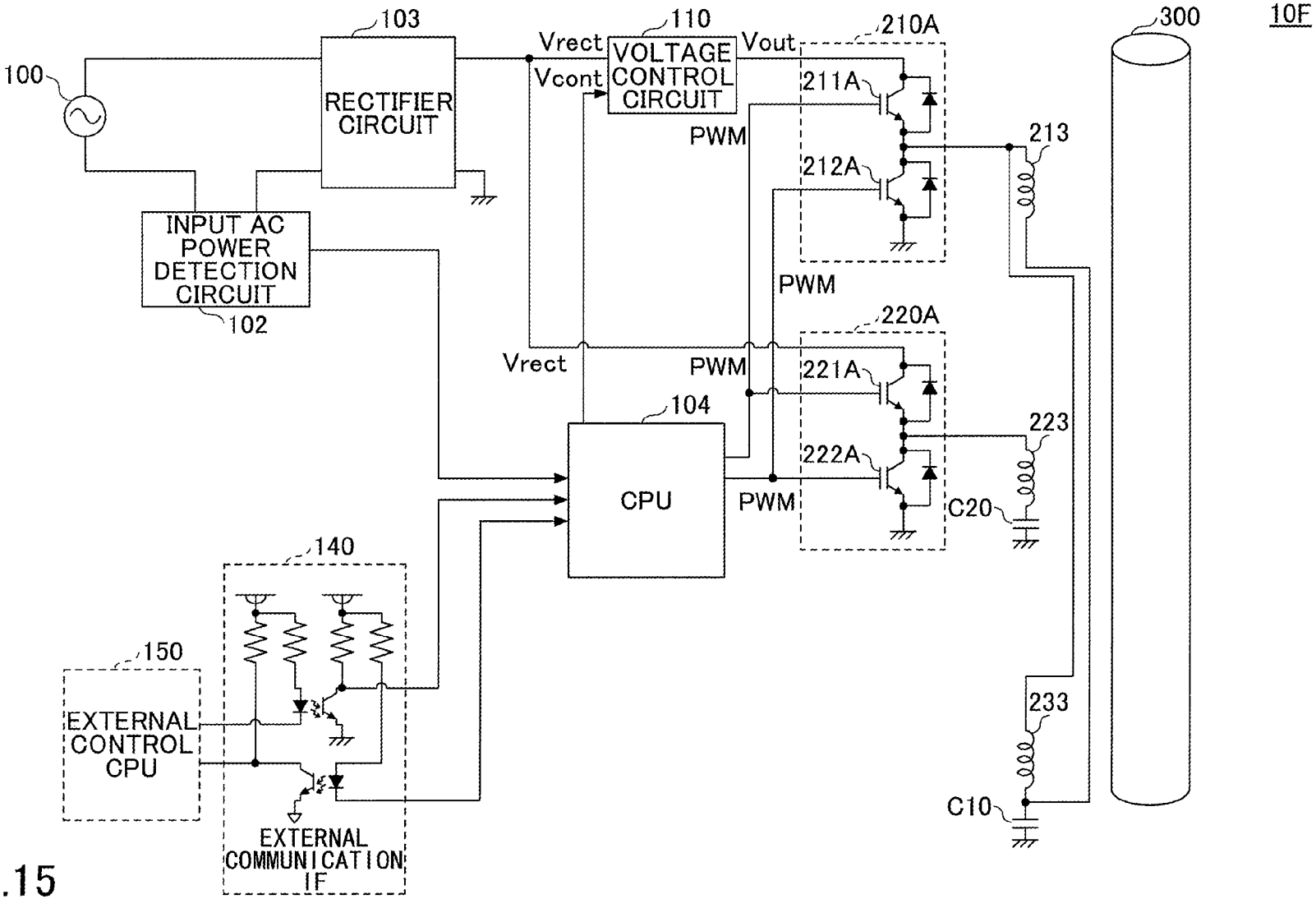
FIG. 15 is a second explanatory diagram illustrating the fixing device according to the sixth embodiment.

FIG. 15 is a second explanatory diagram illustrating the fixing device according to the sixth embodiment.

In the fixing device 10F according to the present embodiment, the heating coil 213 and the heating coil 233 which are connected in parallel are connected to the coil drive unit 210A, and the resonance capacitor C10 is connected between the connection point at which the heating coil 213 and the heating coil 233 are connected and the ground. Moreover, the heating coil 223 is connected to the coil drive unit 220A according to the present embodiment, and the resonance capacitor C20 is connected between the heating coil 223, and the resonance capacitor C20 is connected between the heating coil 223 and the ground.

In the present embodiment, the same effect as in the third embodiment can be obtained.

(Seventh Embodiment)

A seventh embodiment of the present invention will be explained with reference to the drawings in the following. In the seventh embodiment of the present invention, the coil drive unit in the fourth embodiment is an electric current resonance circuit. Accordingly, in the following explanation in the seventh embodiment, only a difference from the fourth embodiment will be explained. To the member having the same functional configuration as in the fourth embodiment, the same reference numeral is assigned as the reference numeral used in the explanation in the fourth embodiment, and the explanation thereof will be omitted.

Figure 16:
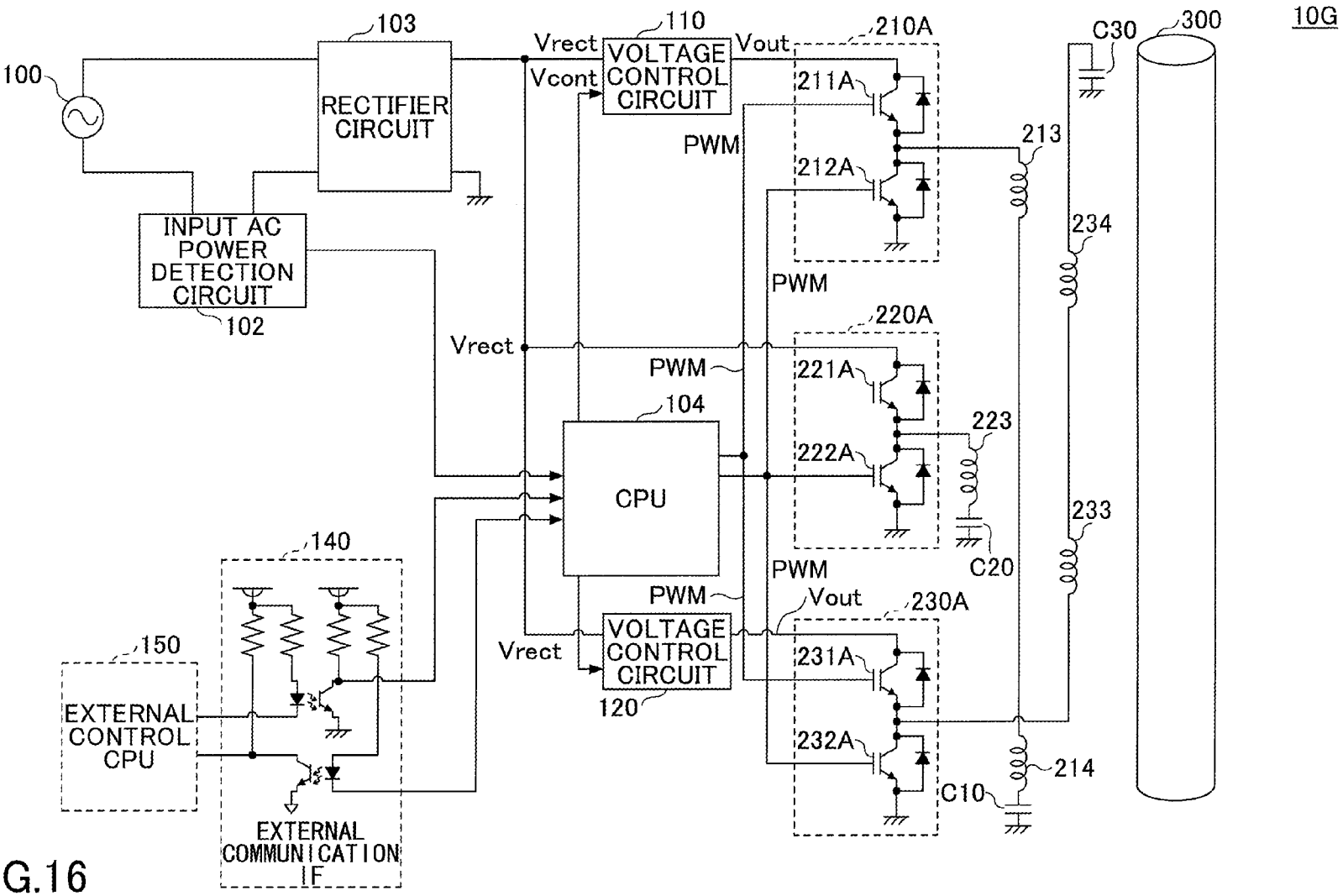
FIG. 16 is an explanatory diagram illustrating a fixing device according to a seventh embodiment.

FIG. 16 is an explanatory diagram illustrating a fixing device according to the seventh embodiment.

In the fixing device 10G according to the present embodiment, the heating coil 213 and the heating coil 214 are connected in series to the coil drive unit 210A, and a resonance capacitor C10 is connected between the heating coil 214 and the ground. Moreover, in the fixing device 10G, the heating coil 233 and the heating coil 234 are connected in series to the coil drive unit 230A, and a resonance capacitor C30 is connected between the heating coil 234 and the ground.

In the present embodiment, the same effect as in the fourth embodiment can be obtained.

Further, the present invention is not limited to these embodiments, but various variations and modifications may be made without departing from the scope of the present invention.

The present application is based on and claims the benefit of priority of Japanese Priority Application No. 2013-140726 filed on Jul. 4, 2013, the entire contents of which are hereby incorporated by reference.

What is claimed is:

1. A fixing device comprising:

a heating body;

a first coil configured to induct heating that heats the heating body by an induction heating method;

a second coil configured to induct heating that heats the heating body by the induction heating method;

a first switching element connected to the first coil for induction heating;

second switching element connected to the second coil for induction heating;

a driving signal transmission unit configured to send a first drive signal to the first switching element and a second drive signal to the second switching element so that the first switching element and the second switching element operate at the same timing to apply a first input voltage to the first coil for induction heating and a second input voltage to the second coil for induction heating; and a voltage control circuit configured to step down the first input voltage applied to the first coil for induction heating so that the first input voltage is lower than the second input voltage, wherein the driving signal transmission unit is configured not to send the first drive signal to the first switching element based on image data used for generating a toner image to fix on a recording medium.

2. The fixing device as claimed in claim 1, wherein the first coil has a coil width which is less than a coil width of the second coil.

3. The fixing device as claimed in claim 1, wherein the first coil includes a plurality of coils for induction heating, and the voltage control circuit is configured to step down the first input voltage applied to the first coil so that the first input voltage is lower than the second input voltage.

4. The fixing device as claimed in claim 2, wherein the first coil is arranged adjacent to an end of the second coil.

5. An image forming apparatus comprising:

a fixing device configured to fix a toner image generated based on image data on a recording medium, the fixing device:

including, a heating body;

a first coil configured to induct heating that heats the heating body by an induction heating method;

a second coil configured to induct heating that heats the heating body by the induction heating method;

a first switching element connected to the first coil for induction heating;

a second switching element connected to the second coil for induction heating;

a driving signal transmission unit configured to send a first drive signal to the first switching element and a second drive signal to the second switching element so that the first switching element and the second switching element operate at the same timing to apply a first input voltage to the first coil for induction heating and a second input voltage to the second coil for induction heating; and a voltage control circuit configured to step down the first input voltage applied to the first coil for induction heating so that the first input voltage is lower than the second input voltage, wherein the driving signal transmission unit is configured not to send the first drive signal to the first switching element based on the image data used for generating the toner image to fix on the recording medium.

* * * * *